US007782263B2

(12) United States Patent
Jow

(10) Patent No.: US 7,782,263 B2
(45) Date of Patent: Aug. 24, 2010

(54) ANTENNA STRUCTURE FOR TPMS TRANSMITTER

(76) Inventor: En-Min Jow, 11F, No. 38-15, Lane 72, Kwang Hwa 2nd Street, Hsinchu (TW)

( * ) Notice: Subject to any disclaimer, the term of this patent is extended or adjusted under 35 U.S.C. 154(b) by 218 days.

(21) Appl. No.: 12/078,971

(22) Filed: Apr. 9, 2008

(65) Prior Publication Data

US 2009/0102731 A1 Apr. 23, 2009

(30) Foreign Application Priority Data

Oct. 19, 2007 (TW) ..... 96139262 A

(51) Int. Cl.
*H01Q 1/32* (2006.01)

(52) U.S. Cl. ..... 343/711; 343/895

(58) Field of Classification Search ..... 343/711, 343/713, 895; 340/442, 445, 447, 448, 449; 73/146.3, 146.4, 146.5, 146.8
See application file for complete search history.

(56) References Cited

U.S. PATENT DOCUMENTS 4,737,760 A * 4/1988 Huang et al. ..... 340/445
5,040,562 A * 8/1991 Achterholt ..... 137/227
6,340,929 B1 * 1/2002 Katou et al. ..... 340/447
7,619,509 B2 * 11/2009 Tanaka ..... 340/442

* cited by examiner

*Primary Examiner*—Hoang V Nguyen
(74) *Attorney, Agent, or Firm*—Rosenberg, Klein & Lee

(57) ABSTRACT

An antenna structure for a TPMS (Tire pressure Monitoring System) transmitter is disclosed herein. A TPMS transmitter couples with a valve so that a spiral coil within the TPMS transmitter can be electrically connected to a conduct body of the valve to get a specific resonance frequency. Hence, the length of the antenna structure can be increased effectively and the efficacy can be raised.

21 Claims, 6 Drawing Sheets

ANTENNA STRUCTURE FOR TPMS TRANSMITTER

BACKGROUND OF THE INVENTION

1. Field of the Invention

The present invention relates to an antenna structure for a TPMS (Tire pressure Monitoring System) transmitter to effectively increase the length of antenna and enhance the efficiency.

2. Description of the Prior Art

After a vehicle has driven for a time or been solarized and been low temperature at night, the vehicle easily produce the leak pressure to cause the pressure value lower the standard. As far as the driving safe is concerned, the leak pressure has the latent danger especial for high speed to break due to the tire pressure not enough, for example.

A prior TMPS transmitter includes a transmitter and a receiver set on or around the appearance of bearing to observe the signal form the transmitter set in the tire any time and to understand the pressure and temperature condition of tire. However, as far as the transmitter is concerned, the main types are internal transmitter and external transmitter, wherein the internal transmitter usually is set in the tire and fixed on the tire frame and the external transmitter set on the valve outside the tire. The module main includes an antenna, a transmitter IC, a micro-processor, a temperature and pressure sensor and a battery shown as in FIG. 1*a*.

However, the framework, which is the antenna structure in printed circuit board (PCB) shown as the FIG. 1*b*, the antenna 11 needs to solder in PCB 10 directly. In order to avoid the antenna arm excessive long to snap by shaking or solder joint loosing, the antenna can be only designed in short shape; however, the design of short antenna is not only not convenient to fabricate but also easy to be short or interference with other electrical components. Besides, the weak intensity signal of short antenna easily causes the receiver error erroneous judgment to affect the driving safe. Moreover, the weak intensity signal needs higher power consumption to enhance the intensity of wireless signal, but that shortens the lifetime of battery.

Another prior art shown as in FIG. 1*c*, the antenna 11 is directly printed in circuit board 10. The method solves the issue of the intensity of antenna structure, but the loop antenna needs a bigger area of antenna's radiator and a whole ground-clearance area to expect effective radiation. Therefore, the transmitter of antenna structure has the issue of too big size.

SUMMARY OF THE INVENTION

The advantages of the present invention will become apparent from the following description taken in conjunction with the accompanying drawings wherein are set forth, by way of illustration and example, certain embodiments of the present invention.

In order to solve the foregoing problems, one object of the present invention is to provide an antenna structure for a TPMS transmitter. A TPMS transmitter couples with a valve so that a spiral coil within the TPMS transmitter can be electrically connected to a conduct body of the valve to get a specific resonance frequency. Hence, the length of the antenna structure may be increased effectively and the radiation efficiency may be raised.

One object of the present invention is to provide an antenna structure for a TPMS transmitter. By increasing the length of antenna the radiation efficiency may be enhanced, the power consumption may be lowered, and then the reduction lifetime of battery may further be improved.

To achieve the objective mentioned above, one embodiment of the present invention of an antenna structure for a TPMS transmitter includes a transmitter module and a spiral coil electrically connected with the transmitter module, wherein the spiral coil within the TPMS transmitter is electrically connected to a conductive body of a valve by screwing method to form the antenna structure for the TPMS transmitter.

To achieve the objective mentioned above, another embodiment of the present invention of an antenna structure for a TPMS transmitter includes: a printed circuit board electrically connected to a battery; a support tube covered the printed circuit board and the battery; a first engaged portion set at an end of the support tube and protruding from the support tube; a coil around the circumference of the support tube to form a portion of an antenna structure, and electrically connected to the first engaged portion and the printed circuit board; a housing covering the coil, the support tube and the printed circuit board to expose the first engaged portion; and a valve with an insulating body, a conductive body and a second engaged portion, wherein the insulating body covers the conductive body; the conductive body penetrates through the insulating body to form another portion of the antenna structure; and the second engaged portion couples with the conductive body and protrudes from the insulating body; whereby screwing the first engaged portion and the second engaged portion to electrically connect the coil with the conductive body.

The basic principle can be known by the principle of the transmission line.

Under the circumstance of open at the receiving end, the input impedance of the transmission line shows the capacitance when the length of the transmission line is shorter than the quarter wavelength. Based on general length of valve about four cm, but the quarter wavelength is 24 and 17 cm in the frequency (315/433 MHz) applied for TPMS, hence, the capacitance exists. Besides, from the basic principle of antenna knows the resonant frequency is produced while the reactance equals zero. By producing the inductance from the spiral coil within the TPMS transmitter. The inductance offset the capacitance of the valve each other to reach the target of resonance frequency applied for TPMS.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

The detailed explanation of the present invention is described as following. The described preferred embodiments are presented for purposes of illustrations and description, and they are not intended to limit the scope of the present invention.

Figure 1A:
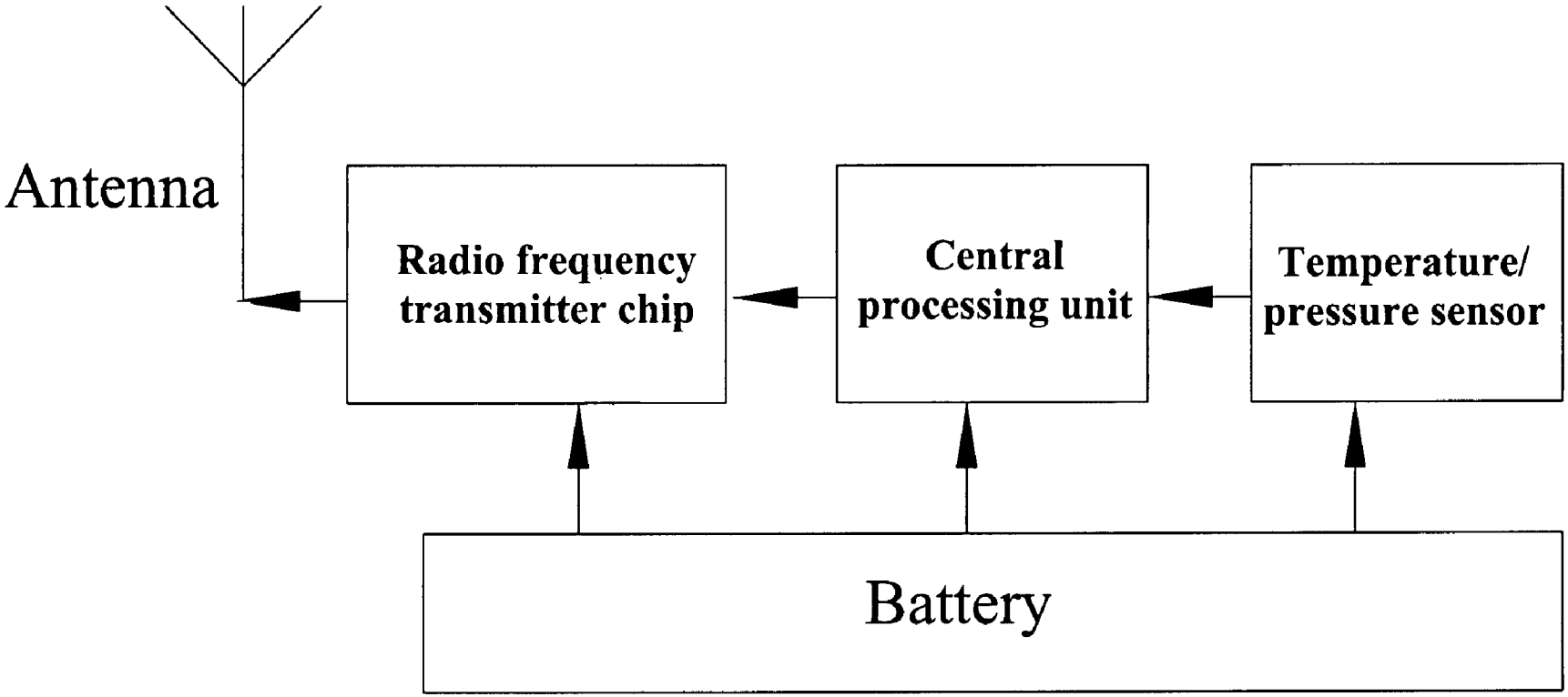
Fig.1a (Prior Art)
FIG. 1*a* is a block diagram illustrating the conventional TPMS transmitter.
Figure 1B:
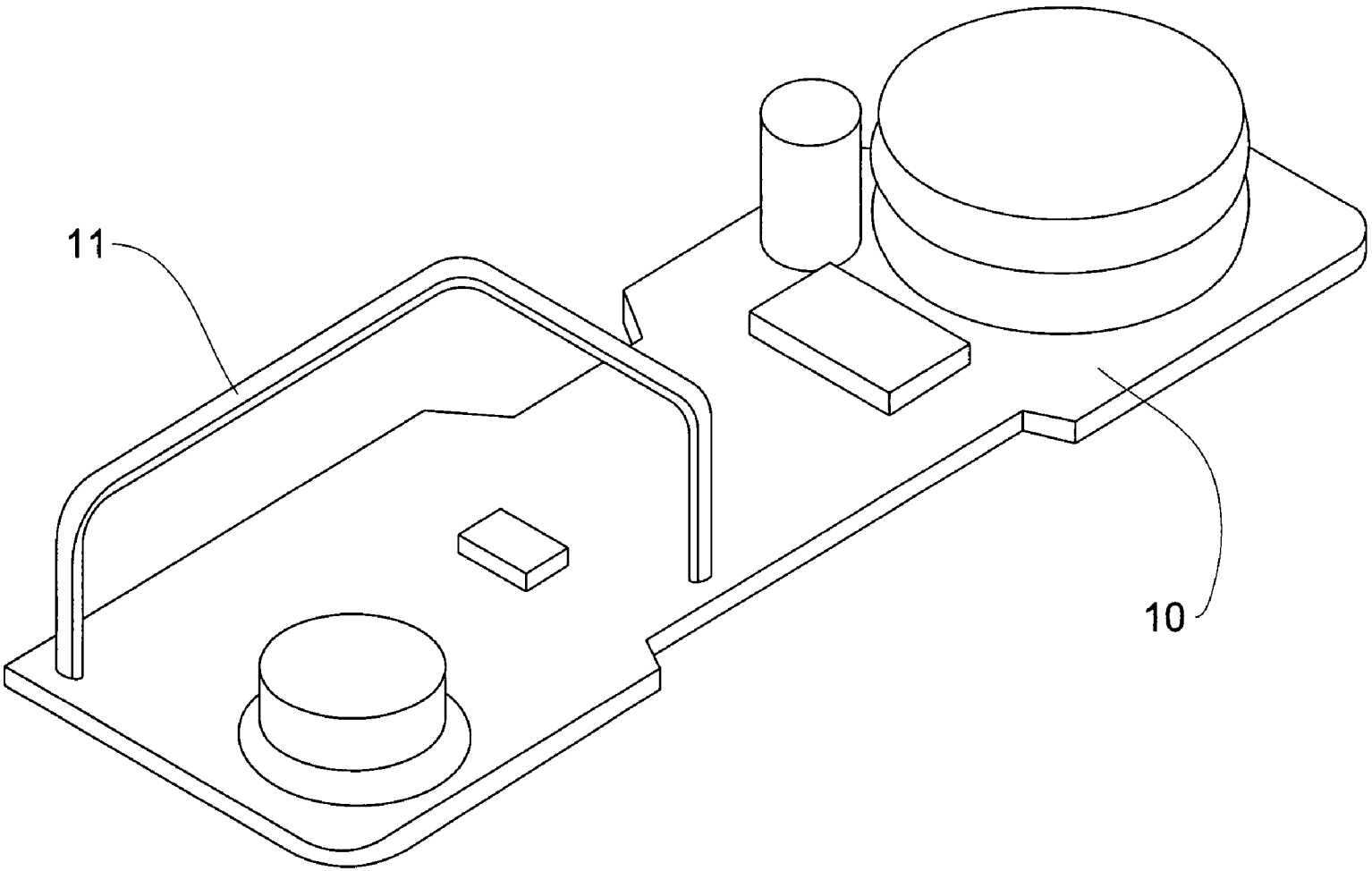
Fig. 1b (Prior Art)
FIG. 1*b* is a three-dimensional diagram illustrating the conventional antenna structure for a TPMS transmitter.
Figure 1C:
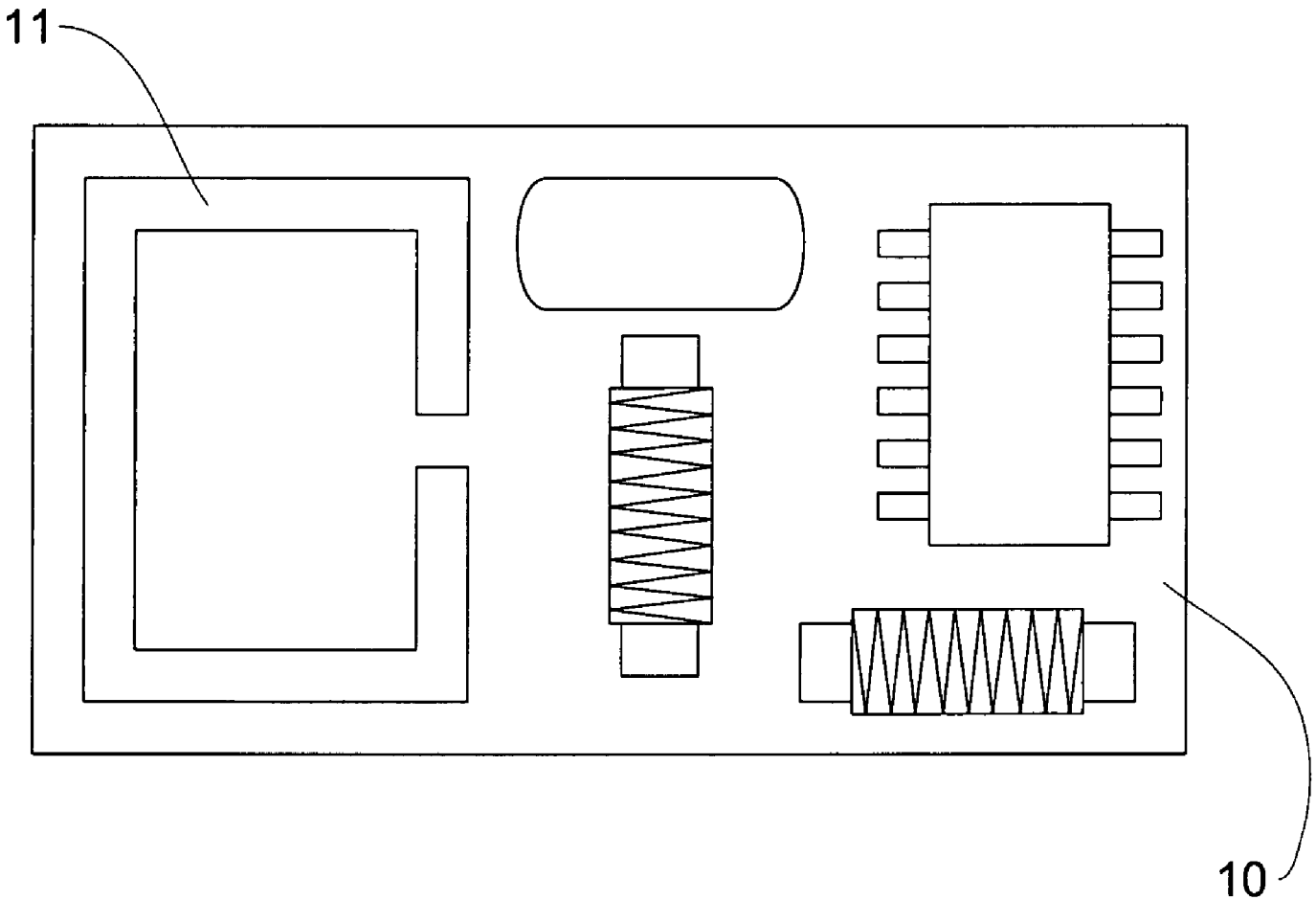
Fig.1c (Prior Art)
FIG. 1*c* is a three-dimensional diagram illustrating the conventional antenna structure for a TPMS transmitter.
Figure 2A:
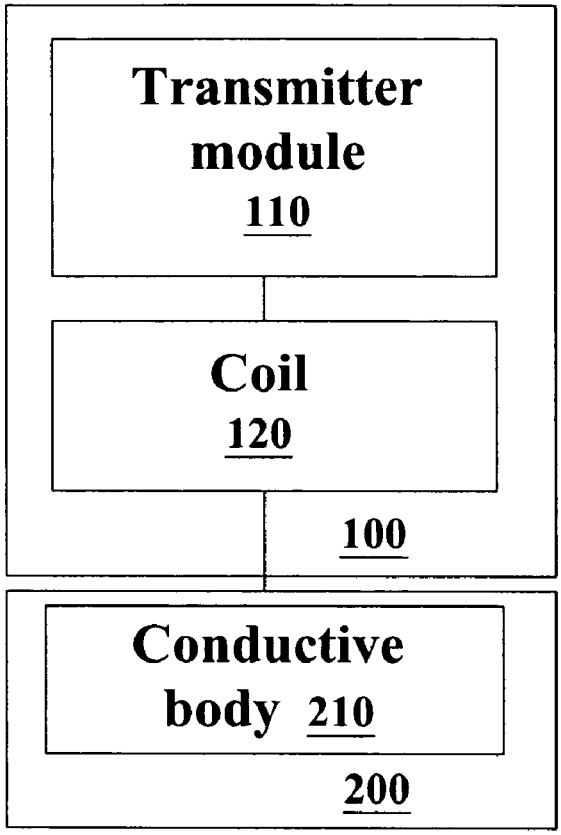
FIG. 2*a*, and FIG. 2*b* are respectively block diagrams illustrating an antenna structure for a TPMS transmitter according to one embodiment of the present invention.
Figure 2B:
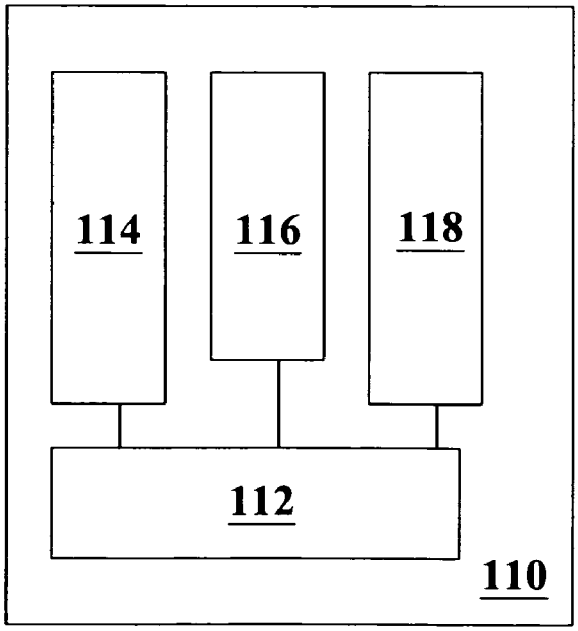

First, please refer to FIG. 2*a* and FIG. 2*b*, the FIG. 2*a* and FIG. 2*b* are block diagrams illustrating the TPMS transmitter. As shown in figure, the antenna structure for a TPMS transmitter 100 includes a transmitter module 110 and a spiral coil 120, and the transmitter module 110 and the spiral coil 120 are electrically connected with each other, whereby the spiral coil 120 is electrically connected to a conductive body 210 of a valve 200 by screwing method to form the antenna structure for the TPMS transmitter 160. In one embodiment, the transmitter module 110 includes a first engaged portion(not shown in the diagram), and the first engaged portion is electrically conducted to the spiral coil 120. Besides, the valve 200 further includes a second engaged portion(not shown in the diagram) which is coupled with the conductive body 210. The present invention utilizes an eye bolt and a matching screw nut to screw the first engaged portion and the second engaged portion so as to make the spiral coil 120 electrically connect to the conductive body 210 to form the antenna structure. By electrically connecting the spiral coil 120 to the conductive body 210 within the valve 200 to reach the specific resonance frequency and to effectively increase the length of antenna and enhance the radiation efficiency. Besides, the transmitter module 110 further includes a printed circuit board 112, a battery 114, a transmitter IC 116, a micro-processor 118, and a temperature and pressure sensor (not shown in figure), wherein the transmitter IC 116, the micro-processor 118, and the temperature/pressure sensor are set on the printed circuit board 112, and the printed circuit board 112 is electrically connected to the battery 114.

Figure 3:
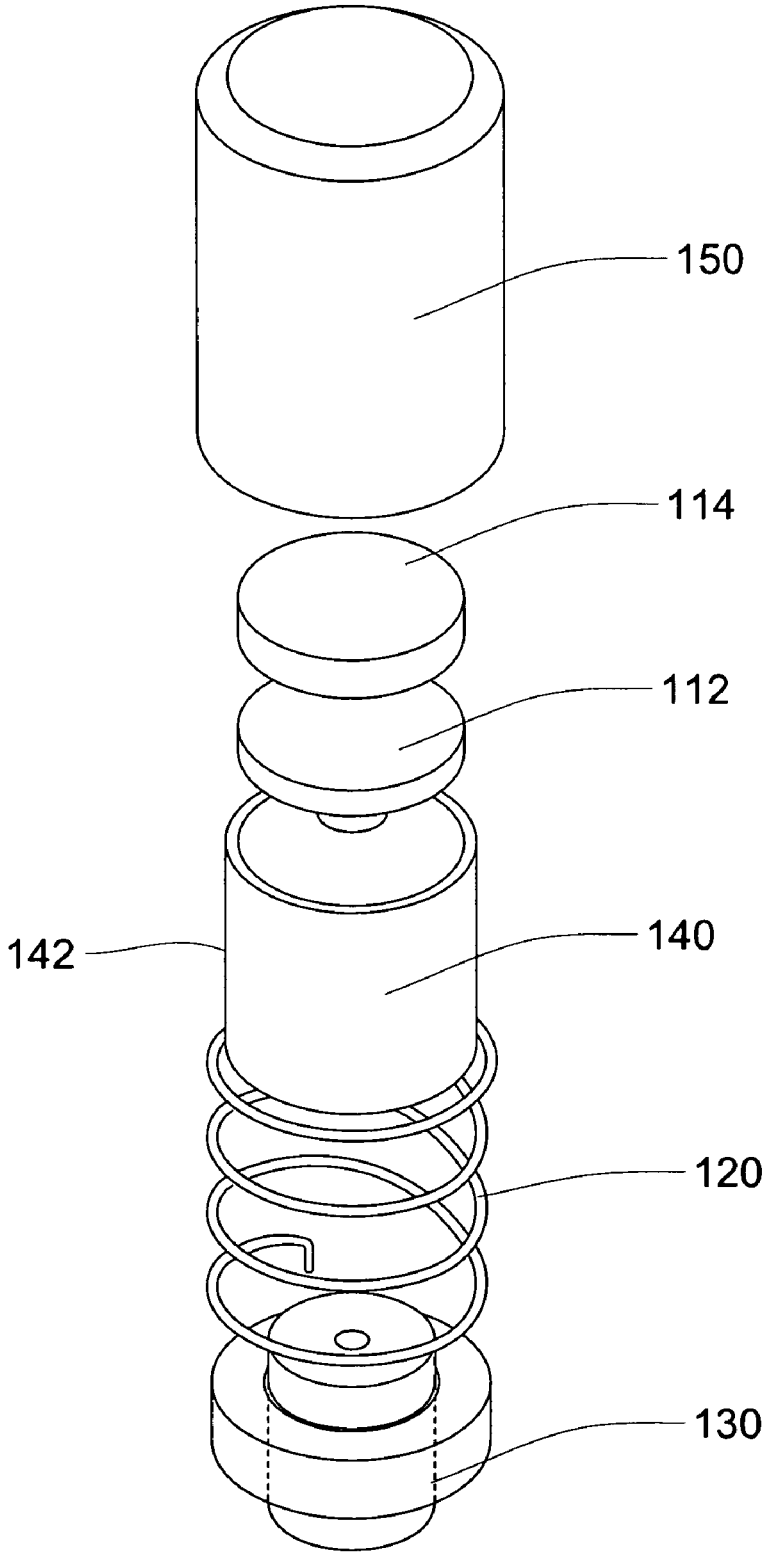
FIG. 3 is part of an exploded diagram illustrating the antenna structure for the TPMS transmitter according to one embodiment of the present invention.

Next, please refer to the FIG. 3, FIG. 3 is a part of an exploded diagram illustrating the antenna structure for the TPMS transmitter according to one embodiment of the present invention. As shown in the figure, the antenna structure for a TPMS transmitter includes a printed circuit board 112 electrically connected with a battery 114 to provide the power to the TPMS transmitter. A support tube 140 covers the printed circuit board 112 and the battery 114, that is to say, the support tube 140 has a space to set the printed circuit board 112 and the battery 114 inside and the printed circuit board 112 is electrically connecting to the battery 114. In one embodiment, the support tube 140 may be made of the insulating material. A first engaged portion 130 is set at an end of the support tube 140 and protruding from the support tube 140. A coil 122 is set around a circumference 142 of the support tube 140 and electrically connected to the first engaged portion 130 and the printed circuit board 112. In one embodiment, the printed circuit board 112 and the battery 114 may be set at an end far from the first engaged portion 130. A housing 150 covers the coil 122, the support tube 140 and the printed circuit board 112 to expose the first engaged portion 130. In one embodiment, the printed circuit board 112 has a pressure sensor IC a temperature sensor IC, a micro-processor, and a transmitter IC thereon to detect the pressure and temperature of a tire any time.

Figure 4:
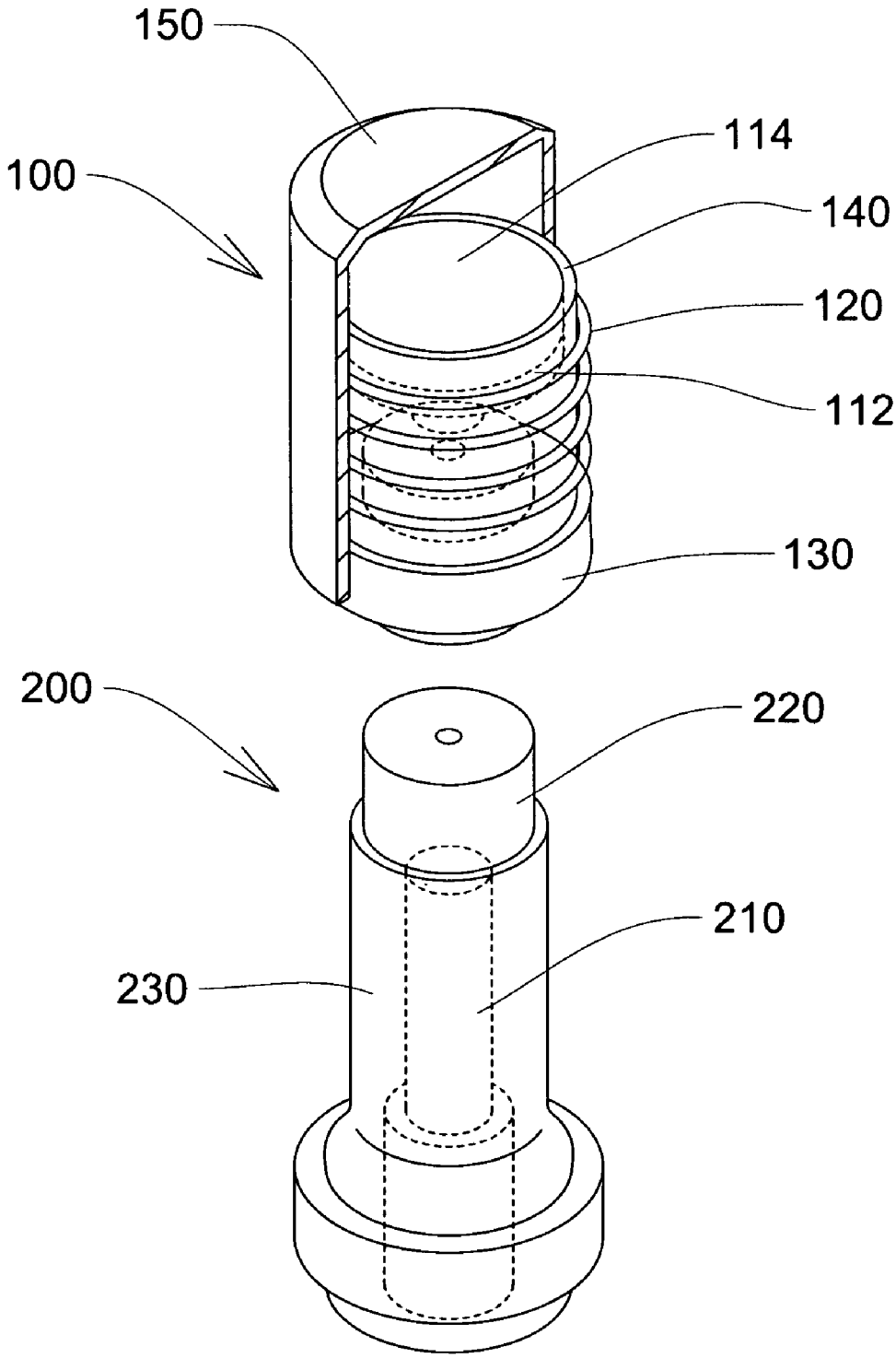
FIG. 4 is an assembly diagram illustrating the antenna structure for the TPMS transmitter according to one embodiment of the present invention.

Continuously, please refer to FIG. 4, FIG. 4 is an assembly diagram illustrating the antenna structure for the TPMS transmitter 100 according to one embodiment of the present invention. Besides the elements mentioned above, a valve 200 has an insulating body 230 and a conductive body 210. As shown in the figure, the insulating body 230 covers the conductive body 210 and the conductive body 210 penetrates through the insulating body 230. Moreover, the valve 200 further includes a second engaged portion 220 coupled with the conductive body 210 and protruding from the insulating body 230. By screwing the first engaged portion 130 and the second engaged portion 220 to electrically, connect the coil 122 with the conductive body 210 to prolong the whole length of the antenna structure to raise the efficiency of antenna. Therefore, the issue of the power consumption of battery may be improved by the raising efficiency of antenna. Moreover, the antenna structure shown in the figure is one of embodiment and may not to limit the present invention with particular form, and the structure of antenna can be applied in internal type transmitter or external type transmitter.

Continuously above description, the first engaged portion 130 may totally protrude from the housing 150 or partially protrude from the housing 150 to conveniently screw the first engaged portion 130 with the second engaged portion 220. In one embodiment, the first engaged portion 130 may further include a screw nut structure and the second engaged portion 220 may be an eye bolt structure matching the screw nut structure; besides, the first engaged portion 130 may also be an eye bolt structure, and the second engaged portion 220 may be a matching structure such as a screw nut structure. But it may be understood that only if the structure such as the first engaged portion 130 engaged with the second engaged portion 220 by screwing method is it involved in the scope of the present invention.

Besides, from the transmission line principle can know that under the circumstance of open at the receiving end, the input impedance of the transmission line shows the capacitance when the length of the transmission line shorter than the quarter wavelength. Based on general length of valve about four cm, the capacitance exists in the frequency (315/433 MHz) applied for TPMS. In one embodiment, the coil 122 can be spiral coil 120 to produce inductance. After the first engaged portion 130 matches with the second engaged portion 220 of the valve 200, the capacitance of the valve 200 may balance the inductance of the coil 122 each other to reach the target of resonance frequency applied for TPMS.

According to the description above, one of the characteristic of the present invention is to produce the inductance by coil offsetting the capacitance of the valve to reach the target of resonance frequency applied for TPMS. Besides, the screwing structure at the coil and the screwing structure of the valve can also be designed that the eye bolt structure of the valve matching the screw nut of structure at the coil by user. Therefore, the structure of antenna can set in internal transmitter or external transmitter and the capacity is high in substantiation.

To sum up the description above, the present invention provides an antenna structure for TPMS transmitter. A TPMS transmitter couples with a valve and a spiral coil within the TPMS transmitter can be electrically connected to a conduct body of the valve to get a specific resonance frequency. Hence, the length of the antenna structure can be increased effectively and the radiation efficiency can be raised. Moreover, by increasing the length of antenna to enhance the radiation efficiency and to lower the power consumption, the reduction lifetime of battery is further improved.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. An antenna structure for a TPMS transmitter, wherein said TPMS transmitter comprises a transmitter module and said antenna structure, and said antenna structure comprises a spiral coil electrically connected with said transmitter module, and a conductive body embedded within a tire valve electrically connected with said spiral coil by screwing said transmitter module and said conductive body together, whereby said TPMS transmitter and said tire valve are also connected.

2. The antenna structure for the TPMS transmitter according to claim 1, wherein said transmitter module comprises a first engaged portion which is electrically conducted to said spiral coil.

3. The antenna structure for the TPMS transmitter according to claim 2, wherein said tire valve further comprises a second engaged portion which is coupled with said conductive body.

4. The antenna structure for the TPMS transmitter according to claim 3, wherein said first engaged portion and said second engaged portion are screwed to each other to electrically connect said spiral coil with said conductive body to form said antenna structure for said TPMS transmitter.

5. The antenna structure for the TPMS transmitter according to claim 1, wherein said transmitter module further comprises a printed circuit board, a battery, a transmitter IC, a micro-processor, and a temperature and pressure sensor, wherein said transmitter IC, said micro-processor, and said temperature/pressure sensor are set on said printed circuit board, and said printed circuit board is electrically connected to said battery.

6. An antenna structure for a TPMS transmitter, comprising:

a printed circuit board electrically connected to a battery;

a support tube covering said printed circuit board and said battery;

a first engaged portion set at an end of said support tube and protruding from said support tube;

a coil around a circumference of said support tube to form a portion of an antenna structure, and electrically connected to said first engaged portion and said printed circuit board;

a housing covering said coil, said support tube and said printed circuit board to expose said first engaged portion; and a valve with an insulating body, a conductive body and a second engaged portion, wherein said insulating body covers said conductive body;

said conductive body penetrates through said insulating body to form another portion of said antenna structure; and said second engaged portion couples with said conductive body and protrudes from said insulating body;

whereby said first engaged portion is screwed with said second engaged portion to electrically connect said coil with said conductive body.

7. The antenna structure for the TPMS transmitter according to claim 6, wherein said first engaged portion protrudes from said housing.

8. The antenna structure for the TPMS transmitter according to claim 6, wherein said first engaged portion comprises a screw nut structure.

9. The antenna structure for the TPMS transmitter according to claim 8, wherein said second engaged portion is an eye bolt structure.

10. The antenna structure for the TPMS transmitter according to claim 6, wherein said first engaged portion is an eye bolt structure.

11. The antenna structure for the TPMS transmitter according to claim 10, wherein said second engaged portion is a screw nut structure.

12. The antenna structure for the TPMS transmitter according to claim 6, wherein said coil is a spiral coil.

13. The antenna structure for the TPMS transmitter according to claim 6, wherein said printed circuit board and said battery set at an end far from said first engaged portion.

14. An antenna structure for a TPMS transmitter which comprises said TPMS transmitter coupling with a valve which is provided with an insulting body and a conductive body, wherein said insulating body covers said conductive body, said conductive body penetrates through said insulating body, and said antenna structure for said TPMS transmitter further comprises:

a printed circuit board electrically connected to a battery;

a support tube covering said printed circuit board and said battery;

a first engaged portion set at an end of said support tube and protruding from said support tube;

a coil around the circumference of said support tube and electrically connected to said first engaged portion and said printed circuit board; and a housing covering said coil, said support tube and said printed circuit board to expose said first engaged portion;

wherein said valve further comprises a second engaging portion coupled with said conductive body and protruded from said insulating body whereby screwing said first engaged portion and said second engaged portion to electrically connect said coil with said conductive body to form said antenna structure for said TPMS transmitter.

15. The antenna structure for the TPMS transmitter according to claim 14, wherein said first engaged portion protrudes from said housing.

16. The antenna structure for the TPMS transmitter according to claim 14, wherein said first engaged portion comprises a screw nut structure.

17. The antenna structure for the TPMS transmitter according to claim 16, wherein said second engaged portion is an eye bolt structure.

18. The antenna structure for the TPMS transmitter according to claim 14, wherein said first engaged portion is an eye bolt structure.

19. The antenna structure for the TPMS transmitter according to claim 18, wherein said second engaged portion is a screw nut structure.

20. The antenna structure for the TPMS transmitter according to claim 14, wherein said coil is a spiral coil.

21. The antenna structure for the TPMS transmitter according to claim 14, wherein said printed circuit board and said battery set at an end far from the said first engaged portion.

* * * * *